US006315477B1

(12) United States Patent
Kuhn et al.

(10) Patent No.: US 6,315,477 B1
(45) Date of Patent: Nov. 13, 2001

(54) WRITING DEVICE WITH AT LEAST TWO WRITING ELEMENTS

(75) Inventors: Martin Kuhn, Fluorn-Winzeln; Ulrich Mueller, St. Georgen-Stockburg, both of (DE)

(73) Assignee: Gebr. Schmidt Fabrik fuer Feinmechanick, St. Georgen/Schwarzwald (DE)

( * ) Notice: Subject to any disclaimer, the term of this patent is extended or adjusted under 35 U.S.C. 154(b) by 0 days.

(21) Appl. No.: 09/492,752

(22) Filed: Jan. 27, 2000

(30) Foreign Application Priority Data

Jan. 29, 1999 (DE) ..... 199 03 394

(51) Int. Cl.[7] ..... B43K 27/02; B43K 24/14
(52) U.S. Cl. ..... 401/32; 401/29
(58) Field of Search ..... 401/29–33, 85, 401/117

(56) References Cited

U.S. PATENT DOCUMENTS 4,165,941 * 8/1979 Kageyama et al. ..... 401/31
4,202,641 * 5/1980 Tomura ..... 401/32
4,968,167 * 11/1990 Kageyama ..... 401/31

FOREIGN PATENT DOCUMENTS 0 216 438 A1 4/1987 (EP) .

* cited by examiner

*Primary Examiner*—Charles R. Eloshway
(74) *Attorney, Agent, or Firm*—Nath & Associates PLLC; Marvin C. Berkowitz; Gary M. Nath

(57) ABSTRACT

A writing device with a housing in which at least two writing elements are arranged and of which one is a lead insert. In order to facilitate the filling of a lead chamber of the lead insert an axially aligned fixed cylinder tube in a back housing part slides into an open top end of the lead chamber. An open top end of the cylinder tube therefore can be filled with lead anytime from a top in a housed as well as in a writing position of the lead insert by opening a top end of the housing.

5 Claims, 1 Drawing Sheet

WRITING DEVICE WITH AT LEAST TWO WRITING ELEMENTS

Such a writing device is described in EP 216 438 for example. In such writing devices it is relatively difficult to refill lead into the lead chamber at the back end of the lead insert. To this end the lead insert must be exposed and removed by removing, e.g. screwing off, one housing element from another, filled with lead and reinserted. In doing so the user often reassembles or uses the writing element incorrectly. Simple pencils with a retractable point with only one writing element insert on the other hand can be filled with lead from the top by removing a cap from the housing with the cap often serving as a retainer for an eraser. This makes the lead chamber of a pencil with a retractable point accessible for refilling purposes.

The object of the invention is to provide a writing device with at least two writing elements of which at least one is a lead insert and in which the filling of lead into the lead chamber of the lead insert is as simple and safe as in a writing device with only one writing element that serves as the lead insert. To a large extent this should be independent of the type of the mechanism that moves the lead from its stationary position in the housing to the writing position in which it protrudes from the housing. This can be a rotating mechanism, a push mechanism or a combination of both types of mechanism.

The object of the invention is attained in accordance with the invention by means of the characteristics of claim 1.

The telescope type engagements of the lead chamber that is open on top with a cylinder tube that reaches to the back end of the writing device and is open at both ends, allows for the use of practically any known mechanism for activating the writing elements that are arranged in the housing, e.g. ballpoint pen refill cartridges, ink cartridges, color cartridges as well as at least one lead insert. The open back end of the cylinder tube is easily accessible from the top, for example by removing a cap in accordance with claim 2, and can be filled with lead. It is substantial that due to the axially fixed cylinder tube it is possible to refill lead easily and safely not only when the lead insert is in the housed position inside the housing but also when the writing insert is extended to the writing position. The longitudinal shifts of lead chamber and cylinder tube that occur when the respective mechanism is operated are compensated by the telescope engagement. Only in the case of rotating mechanisms in which the respective operated writing inserts are rotated in circumferential direction of the housing, is it necessary to ensure a free rotational movement of the cylinder tube together with the writing insert that is aligned axially with it. Such an embodiment is protected in sub-claims 3 and 4. Especially practical is the use of a known per se visual selection push mechanism according to claim 5 in which generally a pendulum or similar object is used for selecting the writing element that is to be extended.

An exemplary embodiment of the invention is shown in more detail by means of the figures.

Figure 1:
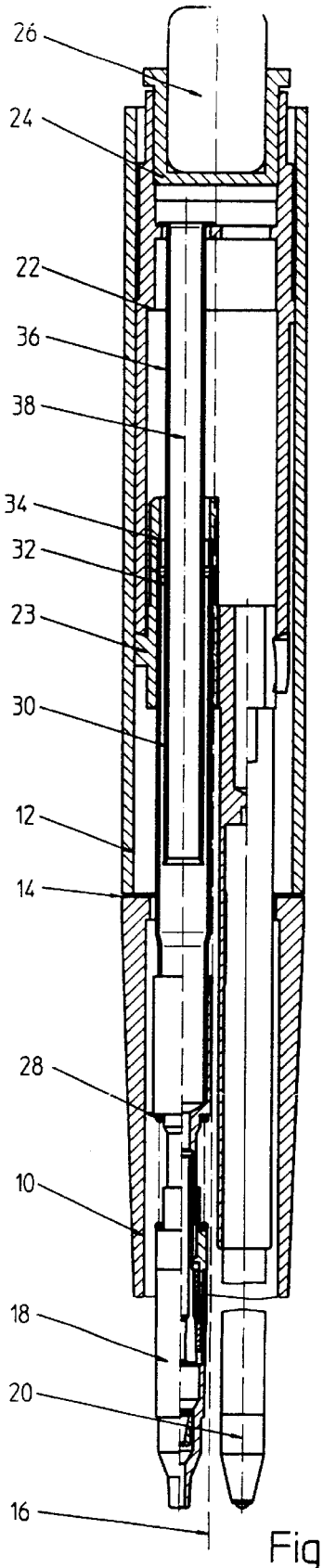
FIG. 1 shows a schematic longitudinal section through the writing device
Figure 2:
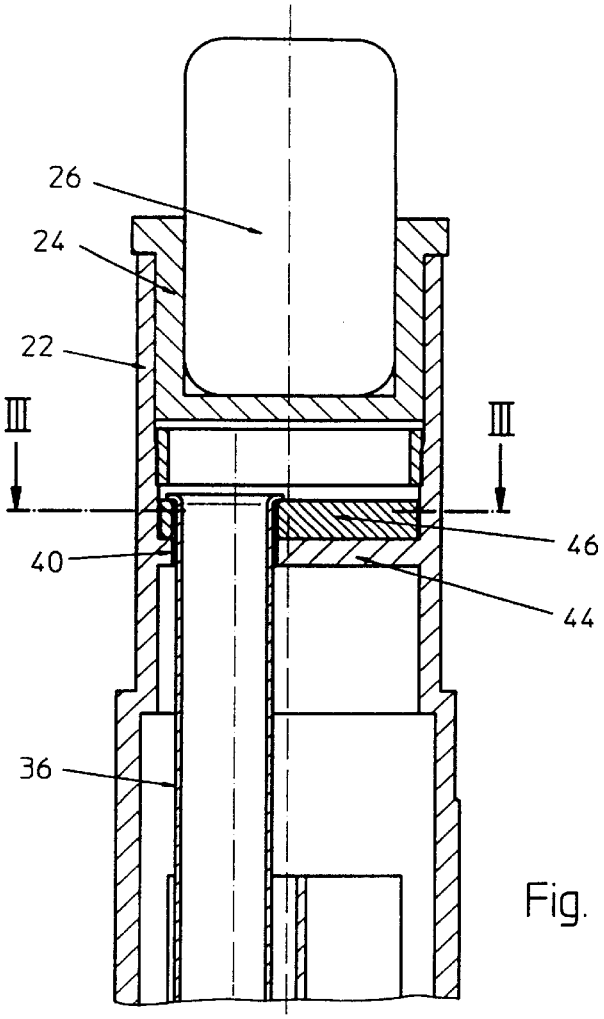
FIG. 2 shows an enlarged partial longitudinal section of the back part of the writing device according to FIG. 1

The writing device shown in the Figures has a housing that is comprised of a front housing part and a back housing part 12 that are engaged longitudinally in a rotating manner along a joint 14 around the longitudinal axis 16 of the housing. In order to provide a better view, the front end of the front housing part 10 is removed in FIG. 1. Two writing elements are arranged inside the housing 10, 12, on one side a lead insert 18 and a ballpoint refill cartridge 20 on the other side. In the back part 12 of the housing a cam 22 is arranged that is part of a rotating mechanism that is known per se and that is known to one skilled in the art. The function of the rotating mechanism and the cam and the engaged trip cams 23 therefore must not be explained in detail. The top of the back part of the housing 12 is closed by a detachable cap 24 with an open space for inserting an eraser 26.

By turning the two housing parts 10, 12 in opposite directions in one direction, the lead insert 18 is moved into the writing position that protrudes to the front from the housing while turning in the opposite direction moves the refill cartridge 20 into the writing position.

The writing element that is not in writing position is moved into its housed position inside the housing by at least one spring, not shown, on the lead insert 18.

The back end of the lead insert 18 is arranged as a tubular lead chamber 30 that is open to the top and that holds the lead. It protrudes into a corresponding bore 32 of the cam 22. A cylinder tube 36 that is open on the top and the bottom protrudes into the open end 34 of the lead chamber 30 from the top in a manner that ensures that its front part is telescopically moveable in the lead chamber 30. The longitudinal axis 38 of the cylinder tube 36 coincides with the longitudinal axis of the lead insert 18. The cylinder tube 36 ends close to the back end of housing part 12 and cam 22 so that when cap 24 is removed from cam 22, it is freely accessible and can be filled, from the top, with lead. Since it is axially fixed to the back part of the housing 12 it can be filled in any axial position of the lead insert 18, i.e. in the retracted housed position as well as in the extended writing position. The longitudinal shift of the lead insert 18 is compensated by the telescope engagement of lead chamber 30 and cylinder tube 36 while the function is maintained.

Figure 3:
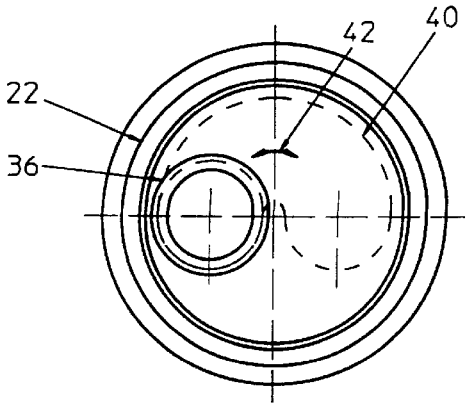
FIG. 3 shows a cross-section along line III—III in FIG. 2.

Since, however, this type of rotating mechanism together with the longitudinal shift of the writing elements causes a rotational shift of the elements in circumferential direction of the housing 10, 12 around the center axis 16 of the housing, this embodiment must ensure that the cylinder tube 36 that is co-axial with the lead insert 18 can follow the rotational movement of lead insert 18 together with chamber 14 and trip cam 23 in an unhampered manner. The back end of the cylinder tube 36 therefore can slide in a semicircle opening 40 as indicated by the double arrow 42 (ref. FIG. 3). The opening 40 is located in a transverse wall 44 of the cam 22 that cannot rotate and is located in the back housing part 12.

Its width corresponds to the outside diameter of the cylinder tube 36 plus corresponding clearance.

In order to prevent lead from accidentally falling into the part of the opening 40 that is not taken up by the cylinder tube 36 when filling lead into the open top end of the cylinder 36, which could result in malfunctions of the mechanism, a sealing washer 46 through which the cylinder tube 36 also runs in a loosely turnable manner is located on the outside of the transverse wall 44.

What is claimed is:

1. A writing device having a housing in which at least two writing elements are arranged of which at least one is a lead insert that, at a back end thereof, has a cylinder-shaped lead chamber that is open at a respective back end thereof for holding lead, wherein the at least two writing elements are movable by a mechanism attached to the housing, the mechanism comprising two housing parts that are moveable with regard to each other about a first axis, the at least two writing elements being movable optionally either to a housed position inside the housing or a writing position that protrudes from a front of the housing, characterized in that:

a front end of a cylinder tube that is open on a respective top and bottom, protrudes into the back end of the lead chamber, the cylinder tube telescopically disposed along an inside of the lead chamber, a back end of the cylinder tube extending close to a back end of the housing, the cylinder tube being fixed axially with regard to the lead chamber along a second axis inside one of the housing parts, the cylinder tube remaining fixed axially with regard to the lead chamber in said one of the housing parts when the one of the housing parts is moved about the first axis relative to an other of the housing parts, whereby the second axis rotates about the first axis.

2. Writing device according to claim 1, characterized in that removing a cap that closes the housing exposes the open back of the cylinder tube.

3. Writing device according to claim 2, wherein the mechanism is a rotating mechanism whereby during mutual relative rotation of the two housing parts one of the at least two writing elements simultaneously carries out a shifting movement in a longitudinal direction and a rotational movement in a circumferential direction of the housing which is forced by a cam that is fixed to a back housing part, characterized in that the cam has a transverse wall having an approximately semicircular opening having a width corresponding to an outside diameter of the cylinder tube and in which the back end of the cylinder tube slides.

4. Writing device according to claim 1, wherein the mechanism is a rotating mechanism whereby during mutual relative rotation of the two housing parts one of the at least two writing elements simultaneously carries out a shifting movement in a longitudinal direction and a rotational movement in a circumferential direction of the housing which is forced by a cam that is fixed to a back housing part, characterized in that the cam has a transverse wall having an approximately semicircular opening having a width corresponding to an outside diameter of the cylinder tube and in which the back end of the cylinder tube slides.

5. Writing device according to claim 4, characterized in that a sealing disk that is rotatable in the cam is carried by the back end of the cylinder tube, whereby the sealing disk closes the opening in the transverse wall other than a portion of the opening disposed over the back end of the cylinder tube.

* * * * *